US006893144B2

(12) United States Patent
Fan

(10) Patent No.: US 6,893,144 B2
(45) Date of Patent: May 17, 2005

(54) WATERPROOF ASSEMBLY FOR ORNAMENTAL LIGHT STRING

(76) Inventor: Ben Fan, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 161 days.

(21) Appl. No.: 10/354,073

(22) Filed: Jan. 30, 2003

(65) Prior Publication Data

US 2004/0150998 A1 Aug. 5, 2004

(51) Int. Cl.[7] ..... F21V 21/00; F21V 31/00

(52) U.S. Cl. ..... 362/249; 362/267; 362/238; 362/219

(58) Field of Search ..... 362/267, 219, 362/238, 226, 249, 252

(56) References Cited

U.S. PATENT DOCUMENTS 6,585,393 B1 * 7/2003 Brandes et al. ..... 362/249
6,695,464 B1 * 2/2004 Wu ..... 362/410
6,715,906 B1 * 4/2004 Wu ..... 362/405
6,758,577 B2 * 7/2004 Wu ..... 362/226

* cited by examiner

*Primary Examiner*—Y. My Quach-Lee
*Assistant Examiner*—Peggy A. Neils
(74) *Attorney, Agent, or Firm*—Rabin & Berdo, P.C

(57) ABSTRACT

A waterproof assembly for an ornamental light string includes a cover mounted around the male connector and having an inner threading formed on an inner periphery of the cover. A sleeve is adapted to be integrally formed around the distal end of the body to enclose the at least two pins. The sleeve has two ribs oppositely formed on an inner periphery of the sleeve. An enclosure is adapted to be integrally formed around a distal end of the female connector and has an outer threading formed to correspond to the inner threading of the cover. A gap is adapted to be sandwiched between a body of the female connector and the enclosure to correspond to the sleeve. The sleeve received in the gap and threading connection between the cover and the enclosure enhance waterproof ability of the ornamental light string.

5 Claims, 6 Drawing Sheets

WATERPROOF ASSEMBLY FOR ORNAMENTAL LIGHT STRING

BACKGROUND OF THE INVENTION

1. Field of the Invention

The present invention relates to a waterproof assembly, and more particularly to a waterproof assembly adapted to be integrally formed on a female connector of an ornamental light string so as to enhance waterproof ability of the ornamental light string.

2. Description of Related Art

With reference to FIGS. 5 and 6, a conventional ornamental light string is composed of a male connector (50) and a female connector (60).

The male connector (50) has a first body (51) made of resin, an enclosure (53) integrally formed on a distal end of the first body (51) to enclose two pins (55) extending out from the distal end of the body (51).

The female connector (60) is composed of a second body (61) with two sockets (611) corresponding to the two pins (55) of the male connector (50), a shoulder (63) formed on an outer periphery of the second body (61) for stopping a seal (65) and a cover (67).

It is noted that the waterproof effect of this conventional ornamental light string is based on an outer threading (531) formed on the enclosure (53) and an inner threading (671) formed on an inner periphery of the cover (67). Therefore, when the ornamental light string is to be assembled, the seal (65) is mounted around the second body (61) and stopped by the shoulder (63). Then the cover (67) is screwingly connected to the enclosure (53) by the corresponding relationship between the inner threading (671) and the outer threading (531). Because the distance from the distal end of the second body (61) to the shoulder (63) is substantially the same as that from the distal end of the enclosure (53) to the distal end of the first body (51), the connection between the cover (67) and the enclosure (53) stops when the distal end of the enclosure (53) abuts the seal (65). From the assembly in FIG. 6, it is noted that the waterproof ability of the ornamental light string is based on the engagement of the enclosure (53) to the cover (67) as well as the seal (65), which is somehow not enough to protect the electrical connection between the pins (55) and the sockets (611).

To overcome the shortcomings, the present invention tends to provide an improved waterproof assembly for ornamental light string to mitigate and obviate the aforementioned problems.

SUMMARY OF THE INVENTION

The primary objective of the present invention is to provide an improved waterproof assembly for ornamental light string so that the waterproof ability of the ornamental light string is further enhanced.

Other objects, advantages and novel features of the invention will become more apparent from the following detailed description when taken in conjunction with the accompanying drawings.

DETAILED DESCRIPTION OF THE PREFERRED EMBODIMENT

Figure 1:
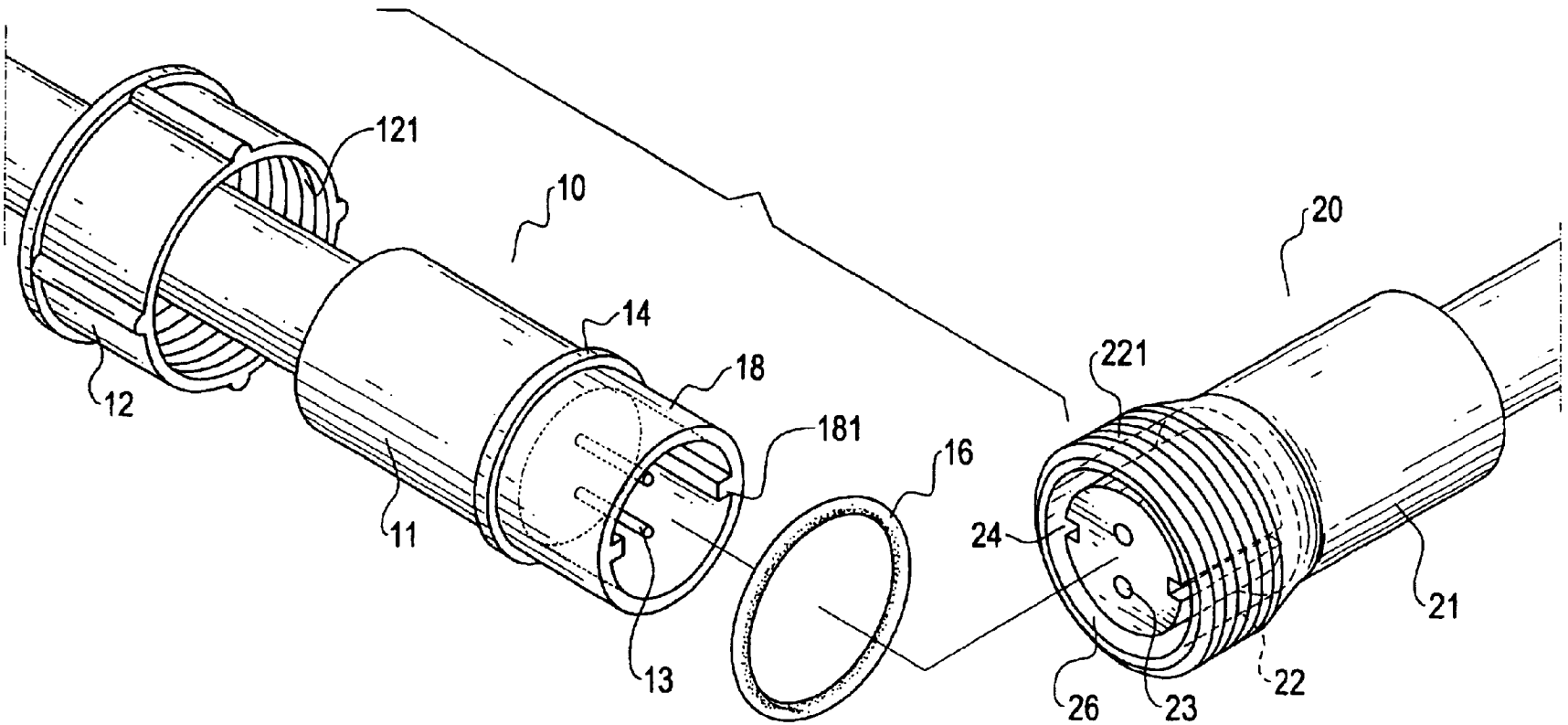
FIG. 1 is an exploded perspective view of the waterproof assembly together with the ornamental light string.

With reference to FIG. 1, an ornamental light string includes a male connector (10) and a female connector (20). The male connector (10) has a cylindrical first body (11) with two pins (13) extending out from a distal end of the first body (11). The female connector (20) has a cylindrical second body (21) with two sockets (23) defined in a distal end of the second body (21) to correspond to the two pins (13) of the first body (11).

The waterproof assembly in accordance with the present invention includes a cover (12) slidably mounted around the first body (11) and provided with a threading (121) defined in an inner periphery of the cover (12). An annular stop (14) is formed on an outer periphery of the first body (11) to abut a seal (16). A sleeve (18) integrally extends from the distal end of the first body (11) to enclose the pins (13). The sleeve (18) has two opposed ribs (181) formed on an inner periphery of the sleeve (18).

The waterproof assembly of the present invention further has an enclosure (22) integrally formed outside the second body (21) and having an outer threading (221) formed to correspond to the cover (12). Two guiding slots (24) are oppositely defined in an outer periphery of the second body (21) to correspond to the two ribs (181). A gap (26) is defined between the enclosure (22) and the second body (21).

When the ornamental light string is to be assembled, the seal (16) abuts the stop (14). The pins (13) of the male connector (10) are inserted into the corresponding sockets (23) of the female connector (20). Because the inner diameter of the sleeve (18) is slightly larger than the outer diameter of the second body (21) and the outer diameter of the sleeve (18) is slightly smaller than an inner diameter of the enclosure (22), the extension of the pins (13) into the corresponding sockets (23) allows the sleeve (18) to be received in the gap (26) with the two ribs (181) received in the corresponding guiding slots (24).

Figure 2:
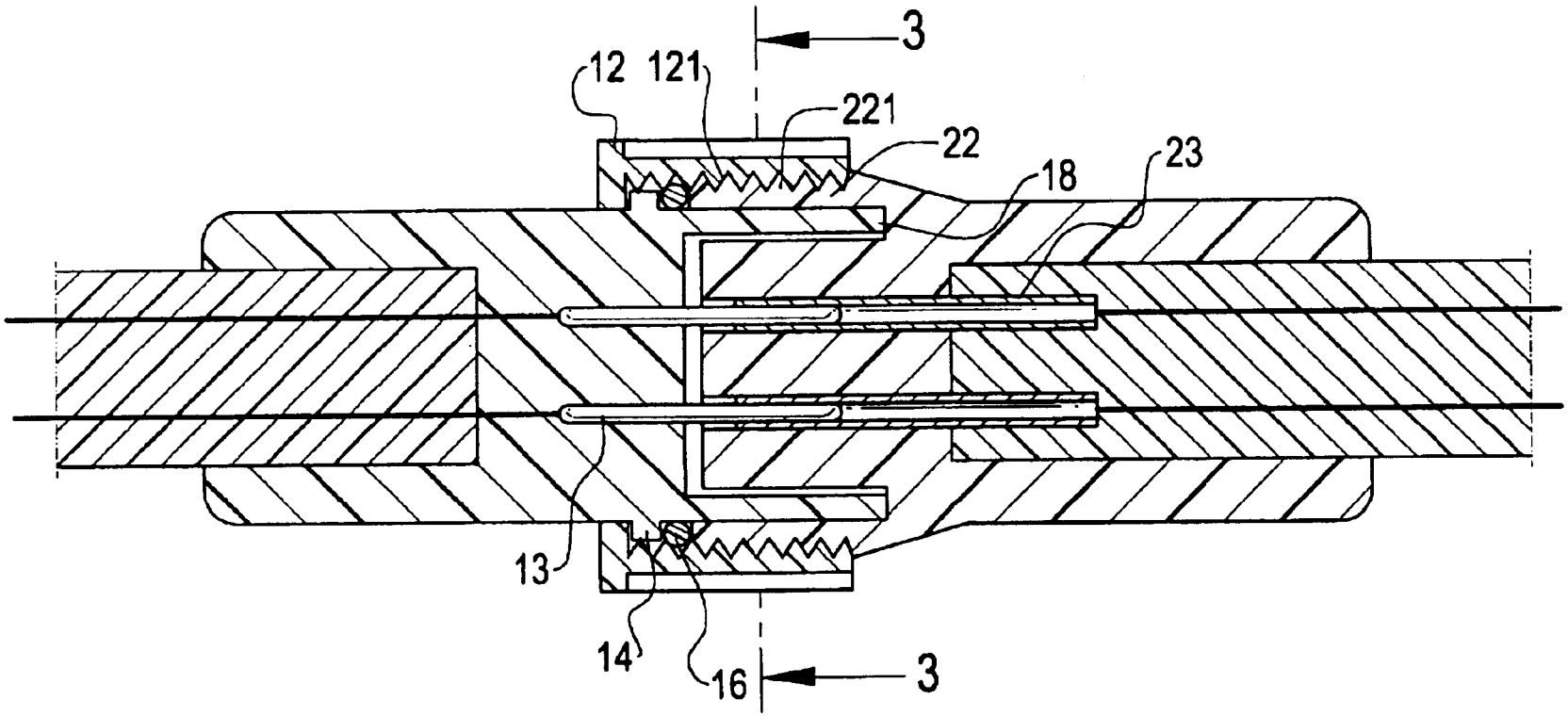
FIG. 2 is a cross sectional view showing the engagement between the male connector and the female connector using the waterproof assembly of the present invention.
Figure 3:
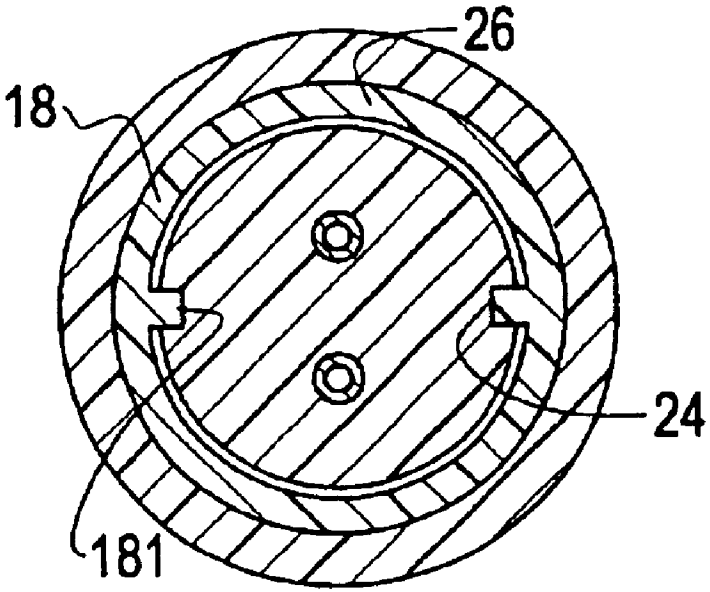
FIG. 3 is a cross sectional view of the ornamental light string in FIG. 2 by taking the line 3—3.

With reference to FIGS. 2 and 3, it is noted that after the assembly of the male connector (10) with the female connector (20), the sleeve (18) received in the gap (26) allows the distal end of the enclosure (22) to sandwich the seal (16) with the stop (14). Further, the addition of the enclosure (22) to the female connector (20) adds an extra waterproof ability to the ornamental light string.

Figure 4:
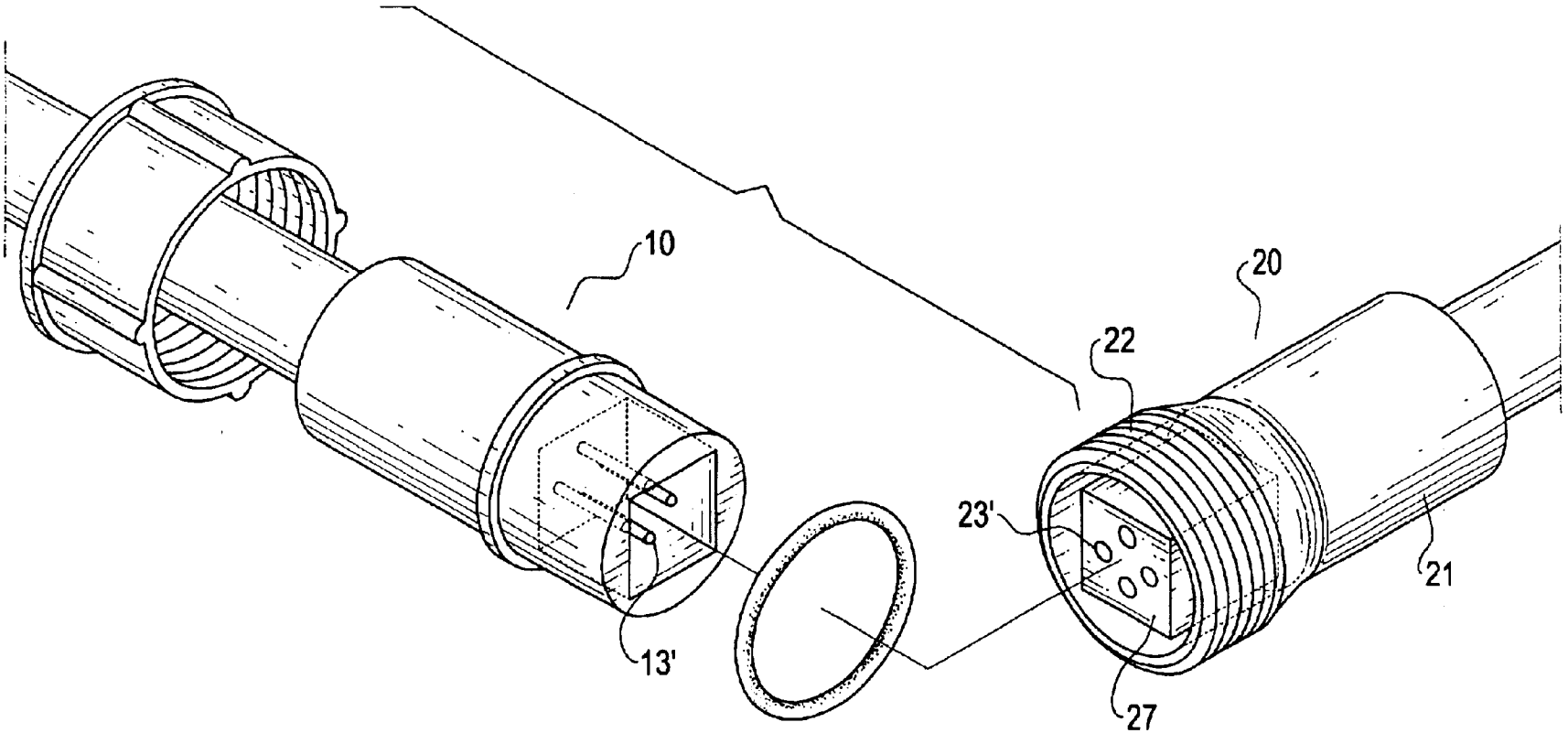
FIG. 4 is an exploded perspective view of the waterproof assembly together with different kind of ornamental light string.
Figure 5:
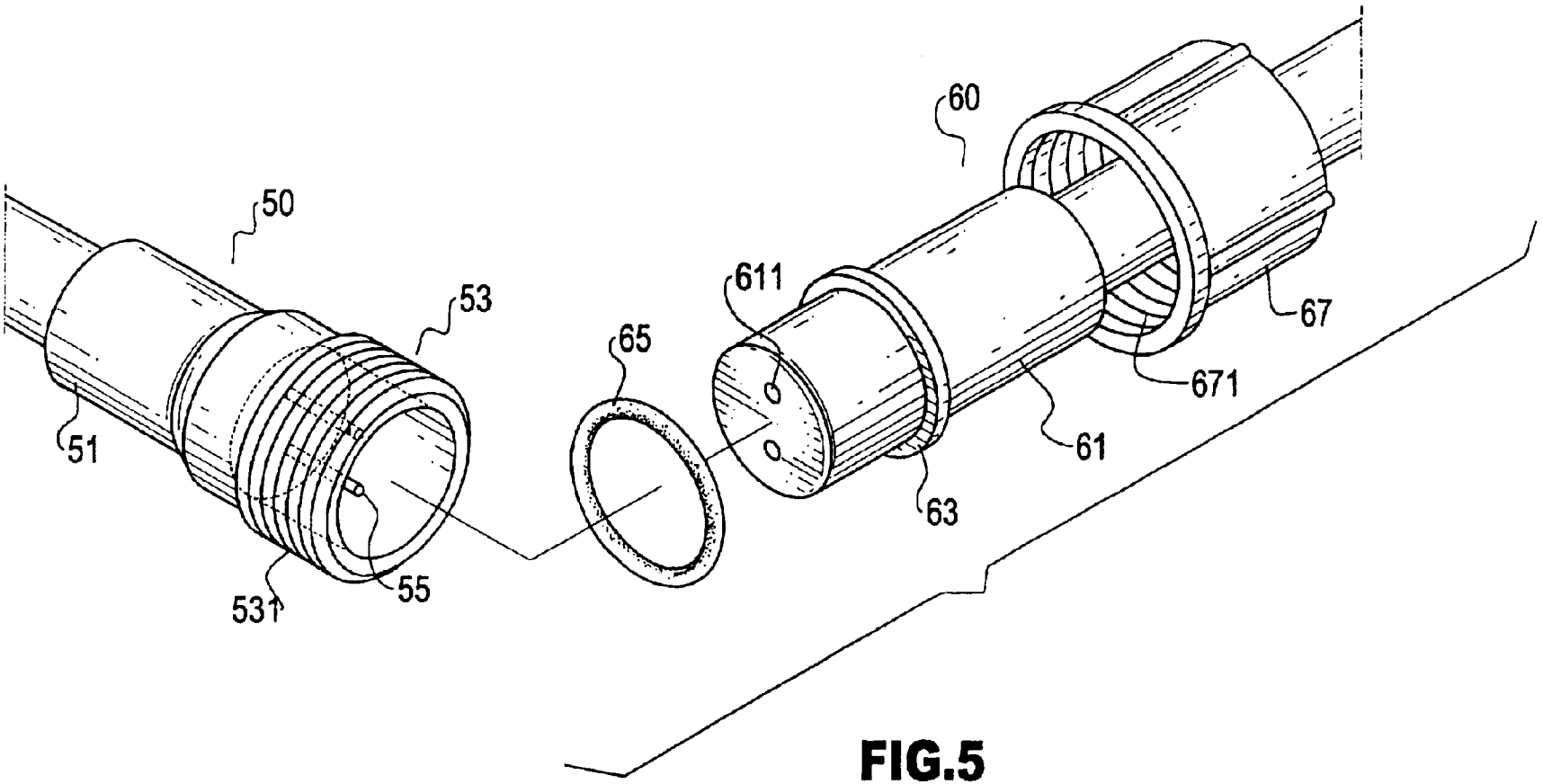
FIG.5 PRIOR ART
FIG. 5 is an exploded perspective view of a conventional light string.
Figure 6:
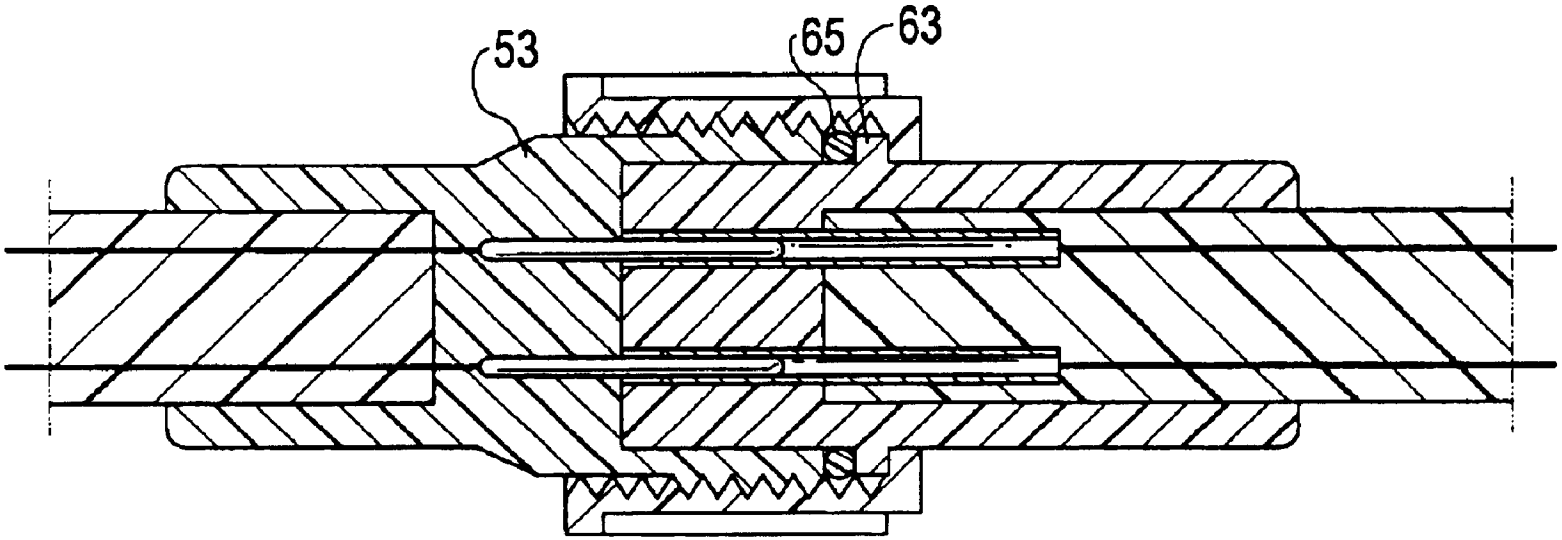
FIG.6 PRIOR ART
FIG. 6 is a cross sectional view of the engagement between the male connector and the female connector of the conventional ornamental light string in FIG. 5.

With reference to FIG. 4, it is noted that the sleeve (18') has a cubic inner space instead of the cylindrical inner space in FIG. 1. In order to correspond to the cubic inner space in the sleeve (18'), the second body (21) has a cubic head (27) so that after the pins (13') (four are shown in this embodiment) are inserted into the socket (23'), no relative rotation exists between the male connector (10) and the female connector (20).

In conclusion, with the addition of the enclosure (22) to the female connector (20), the waterproof ability of the ornamental light string is enhanced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In an ornamental light string having a male connector which is provided with a cylindrical first body with a sleeve integrally extending out from the cylindrical first body, an annular stop formed on an outer periphery of the cylindrical first body to abut a seal, at least two pins extending out from the cylindrical first body and a cover slidably mounted around the cylindrical first body and having an inner threading formed on an inner periphery of the cover and a female connector having a cylindrical second body which has at least two sockets defined in a distal end of the cylindrical second body to correspond to the at least two pins of the male connector, wherein the improvements comprise:

an enclosure is integrally formed around the cylindrical second body and has an outer threading formed on an outer periphery of the enclosure to correspond to the inner threading of the cover, and a gap is defined between the cylindrical second body and the enclosure, whereby after the at least two pins of the male connector are inserted into the corresponding at least two sockets of the female connector, the sleeve is received in the gap and threading connection between the cover and the enclosure enhances waterproof ability of the ornamental light string.

2. The ornamental light string as claimed in claim 1, wherein the gap has an outer diameter adapted to be larger than an outer diameter of the sleeve so as to allow the sleeve to extend into the gap.

3. The ornamental light string as claimed in claim 2, wherein two ribs are adapted to be oppositely formed on an inner periphery of the sleeve to correspond to two guiding slots adapted to be oppositely defined in the cylindrical second body of the female connector so that after the engagement between the male connector and the female connector, relative position of the male connector to the female connector is secured.

4. A waterproof assembly for an ornamental light string having a male connector with at least two pins extending from a distal end of the male connector and a female connector detachably connected to the male connector and having at least two sockets corresponding to the at least two pins, the waterproof assembly comprising:

a cover adapted to be slidably mounted around a body of the male connector and having an inner threading formed on an inner periphery of the cover;

an annular stop adapted to be integrally formed on the body of the male connector;

a seal adapted to be mounted on the body of the male connector to abut the annular stop;

a sleeve adapted to be integrally formed around the distal end of the body to enclose the at least two pins, the sleeve having two ribs oppositely formed on an inner periphery of the sleeve;

an enclosure adapted to be integrally formed around a distal end of the female connector and having an outer threading formed on an outer periphery of the enclosure to correspond to the inner threading of the cover;

a gap adapted to be sandwiched between a body of the female connector and the enclosure to correspond to the sleeve; and two guiding slots adapted to be oppositely defined in a body of the female connector to correspond to the two ribs, whereby after the at least two pins of the male connector are inserted into the corresponding at least two sockets of the female connector, the sleeve is received in the gap and threading connection between the cover and the enclosure enhances waterproof ability of the ornamental light string.

5. The ornamental light string as claimed in claim 4, wherein the gap has an outer diameter larger than an outer diameter of the sleeve so as to allow the sleeve to extend into the gap.

* * * * *